US011439893B2

(12) United States Patent
Shoaff et al.

(10) Patent No.: US 11,439,893 B2
(45) Date of Patent: Sep. 13, 2022

(54) GAME APPARATUS WITH DEFORMING PLAYING DISCS

(71) Applicant: Hasbro, Inc., Pawtucket, RI (US)

(72) Inventors: Matthew Shoaff, Pawtucket, RI (US); Lee M Lenkarski, Belchertown, MA (US); Olivia Yeung Wing Ka, Hong Kong (HK); Wong Wai Shun, Hong Kong (HK)

(73) Assignee: Hasbro, Inc., Pawtucket, RI (US)

( * ) Notice: Subject to any disclaimer, the term of this patent is extended or adjusted under 35 U.S.C. 154(b) by 14 days.

(21) Appl. No.: 17/029,924

(22) Filed: Sep. 23, 2020

(65) Prior Publication Data

US 2021/0093945 A1 Apr. 1, 2021

Related U.S. Application Data

(60) Provisional application No. 62/906,610, filed on Sep. 26, 2019.

(51) Int. Cl.
*A63F 3/00* (2006.01)
*A63F 9/02* (2006.01)

(52) U.S. Cl.
CPC ..... *A63F 3/00634* (2013.01); *A63F 3/00533* (2013.01); *A63F 9/0252* (2013.01); *A63F 9/0278* (2013.01); *A63F 2003/0041* (2013.01); *A63F 2003/00548* (2013.01); *A63F 2003/00637* (2013.01)

(58) Field of Classification Search
CPC ..... A63F 3/00634; A63F 3/00533; A63F 9/0252; A63F 9/0278; A63F 2003/0041; A63F 2003/00548; A63F 2003/00637; A63F 2003/00757; A63F 2009/0221; A63F 2009/0282; A63F 9/0204; F41J 1/10; F41J 5/205
See application file for complete search history.

(56) References Cited

U.S. PATENT DOCUMENTS

| | | | | |
|---|---|---|---|---|
| 1,168,854 A | | 1/1916 | Chase | |
| 1,268,115 A | * | 6/1918 | Haines | A63F 9/02 273/356 |
| 2,432,824 A | | 12/1947 | Shetler | |
| 3,675,924 A | | 7/1972 | Smith | |
| 3,797,828 A | * | 3/1974 | Ishikawa | A63F 7/025 273/138.3 |
| 4,243,227 A | | 1/1981 | Strongin | |
| 4,582,326 A | | 4/1986 | Alsip | |
| 4,651,996 A | | 3/1987 | Watkins, Jr. | |
| 5,154,428 A | | 10/1992 | Woolhouse | |
| 5,277,419 A | | 1/1994 | Craig | |

(Continued)

*Primary Examiner* — Michael D Dennis
(74) *Attorney, Agent, or Firm* — Perry Hoffman

(57) ABSTRACT

A strategic pattern building game apparatus having a target grid and a rotatable loading tray movable between an elevated position above and aligned with the target grid during play and a folded position adjoining the target grid for transport and/or storage. The game apparatus includes a plurality of playing discs which are placed in channels in the target grid and in the loading tray, and projectile launchers used by players to knock out playing discs until one player achieves four of his/her discs in a horizontal, vertical or diagonal line. The discs are deformable and received at the target grid for being ejected during game play when impacted by the projectile.

20 Claims, 13 Drawing Sheets

(56) References Cited

U.S. PATENT DOCUMENTS

| | | | | |
|---|---|---|---|---|
| 5,435,570 | A | 7/1995 | Labrasseur | |
| 5,613,681 | A * | 3/1997 | Allen | A63F 3/00094 273/153 R |
| 6,428,003 | B1 * | 8/2002 | Fondin | A63F 3/00094 273/287 |
| 6,702,285 | B2 * | 3/2004 | Cheng | A63F 9/12 273/153 R |
| 7,810,814 | B1 | 10/2010 | Chapman et al. | |
| 7,900,925 | B2 * | 3/2011 | Hextall | A63F 3/00 273/287 |
| 8,387,988 | B2 | 3/2013 | Van Ness | |
| 2014/0159309 | A1 | 6/2014 | Jiang | |

* cited by examiner

GAME APPARATUS WITH DEFORMING PLAYING DISCS

PRIORITY CROSS-REFERENCE TO RELATED APPLICATIONS

This application claims priority pursuant to 35 U.S.C. 119(e) from U.S. Provisional Patent Application No. 62/906,610 filed on Sep. 26, 2019.

FIELD OF THE INVENTION

The present invention relates generally to a game apparatus and deformable discs and, more particularly, to a game apparatus having an upper loading tray and a lower target grid for receiving playing discs that are deformable, and further to a board game that involves strategic pattern building with a feature for ejecting game pieces during game play when impacted by a projectile.

BACKGROUND OF THE INVENTION

Game involving abstract strategy pattern building for competition between two or more players using launching devices and the like with playing piece compartments and multiple levels as increasing the complexity of games of chance is known as popular forms of entertainment for people of all ages. These types of games have been designed both for a single player and for competition between two or more players. Many games, such as Yahtzee™, mainly involve chance. Many games, such as backgammon, involve a combination of chance and skill, and many games, such as chess, mainly involve skill. Since 1974, the genre of pattern building games has included the very popular game of CONNECT FOUR® or CONNECT 4®, a game also published by Milton Bradley™. A much older version of Connect Four™ is known as "The Captain's Mistress". Such CONNECT FOUR® games are well known and popular parlor games marketed by Hasbro Gaming of Pawtucket, R.I. The basic game facilitates a two-player connection game in which the players choose a color and then take turns dropping one colored disc from the top into a seven-column, six-row suspended grid with an objective of being first to form a series four of common player discs. These games relate to games of skill involving a competition between two or more players to build a desired pattern on the game board while preventing other players from building the desired pattern.

A number of variations of the game now exist. For example, see U.S. Pat. No. 7,810,814, entitled "Strategic Pattern Building Board Game With Ejecting Feature" issued in 2010 to Chapman and Lenkarski, and illustrating a seven-column, five-row game board of vertically suspended walls 10, 14, the wall having apertures 12, 16, and featuring a retainer of shifting and pivotal bars 22, 24 that allow all playing markers 34 to be ejected by falling into an attachment tray 28. U.S. Patent Application No. 2014/0159309 to Jiang for "Strategic Pattern Building Game" published Jun. 12, 2014 provides a strategic pattern building game that includes a marker matrix configured to receive playing markers along an insertion edge of the marker matrix and guide each of the playing markers into one of a plurality of predefined positions. The marker matrix is configured to define a plurality of parallel channels that segregate the plurality of predefined positions into one of horizontal rows and vertical columns, and configured to receive playing markers into an insertion position adjacent an insertion edge of the marker matrix.

A further category of games involves games where playing pieces are launched onto a game board with the objective of either landing the playing pieces on the board in a certain manner or landing the playing pieces on certain areas of the board to achieve a certain score. U.S. Pat. No. 5,154,428 to Woolhouse for "Military game apparatus" issued Oct. 13, 1992 describes first and second hinge mounted housings assemblies with representative tokens configured displaceable along playing fields during play of the game, configured as including artillery and operative as a catapult to project various projectile members against an opposing player tokens. U.S. Pat. No. 3,675,924 to Smith for "Projection Game Apparatus Including Paper Clip Projector And Closely Spaced Target Posts" discloses a game apparatus for projecting lightweight planar objects using a paper clip toward a plurality of spaced posts for individually ringing posts, leaning against one or several posts, or being suspended against gravity upon the plateau-like tops of two or more posts, the game board existing in a single plane. The concept of launching playing markers into a game board to achieve a desired pattern is also known in the prior art. U.S. Pat. No. 4,243,227 to Strongin, for "Disc Projecting Game" discloses an action toy game wherein players launch game pieces through an upwardly-arched arcuate guide channel with the goal of landing the game pieces into a vertically supported hollow display section with a plurality of vertical compartments and with the further goal of achieving a certain pattern within the vertical compartments.

A disadvantage of the prior art is that it does not allow for a variety of games within embodiments where some games have the characteristics of a competitive sport where players act simultaneously and other games that involve intellectual strategy and skilled coordination in alternating turns. A target game apparatus with a target grid for impact by a toy projectile to enable the playing piece to fall out of the target grid in a strategic pattern building board game having a vertically suspended matrix that allows games pieces to be both inserted into the matrix and ejected from the matrix during game play is unknown in the prior art.

SUMMARY OF THE INVENTION

The game board apparatus described in detail here is another variation of the famous and popular games CONNECT 4 and CONNECT FOUR. The game board apparatus includes an assembly of a target grid with a plurality of channels, a foldable loading tray and a plurality of game pieces or playing discs. As with the earlier CONNECT 4 and CONNECT FOUR broad games, the primary object of the game is to be the first player to align four of his/her playing discs in a continuous line extending in a horizontal, a vertical or a diagonal direction. The distinctive approach here is that the target grid is loaded with playing discs of one indicium or color, perhaps blue, while the loading tray, mounted above the target grid, is loaded with players' discs of two different indicia or colors, perhaps red and yellow. The two players then use soft foam dart launchers or 'blasters' to 'shoot' away the blue, (or red, or yellow discs) in the target grid such that a red or a yellow disc from the loading tray is able to fall into a channel from which the blue, red or yellow disc was expelled. The loading tray is randomly loaded and is covered in both the front and the back so that the players are unable to see which colored disc, red or yellow, is likely to fall into the target grid channel from which he/she removed a disc. The discs may be deformable with the game apparatus having an upper loading tray and a lower target grid for receiving the playing discs for ejecting game pieces during game play when impacted by the projectile as involving strategic pattern building with features disclosed.

The inventive game apparatus is simply constructed with few and relatively inexpensive parts, and yet the game apparatus is structurally robust and the game is fun to play.

BRIEF DESCRIPTION OF THE DRAWINGS

For the purpose of facilitating an understanding of the invention, the accompanying drawings and detailed description illustrate preferred embodiments thereof, from which the invention, its structures, its constructions and operations, its processes, and many related advantages may be readily understood and appreciated.

DETAILED DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
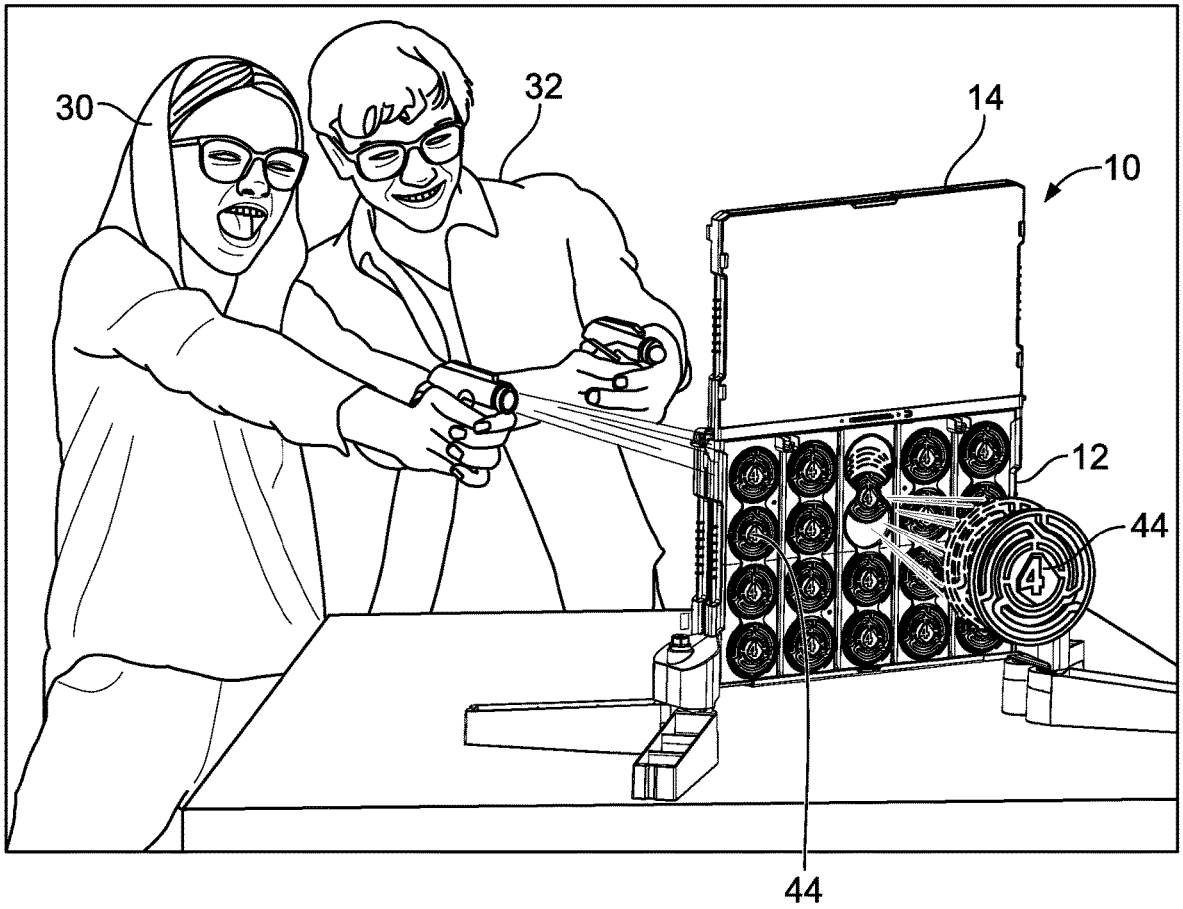
FIG. 1 is an isometric view of an embodiment of the inventive game apparatus and two players, and illustrates a dart knocking or popping out a playing disc from a target grid.
Figure 2:
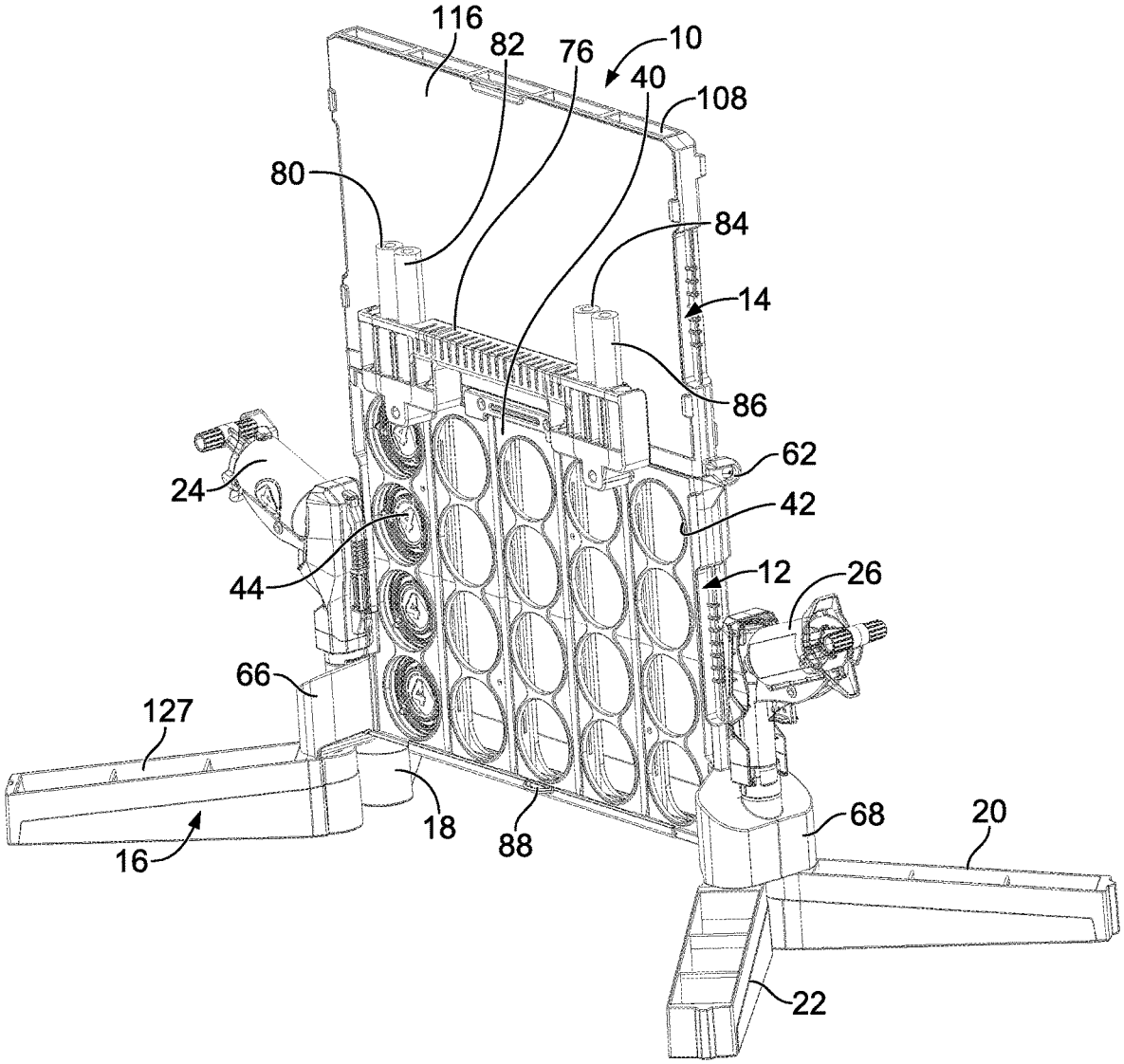
FIG. 2 is an isometric view of the game apparatus illustrated in FIG. 1, including the target grid, a loading tray, support legs and two mounted launchers, when the game apparatus is illustrated in a fully opened configuration.
Figure 3:
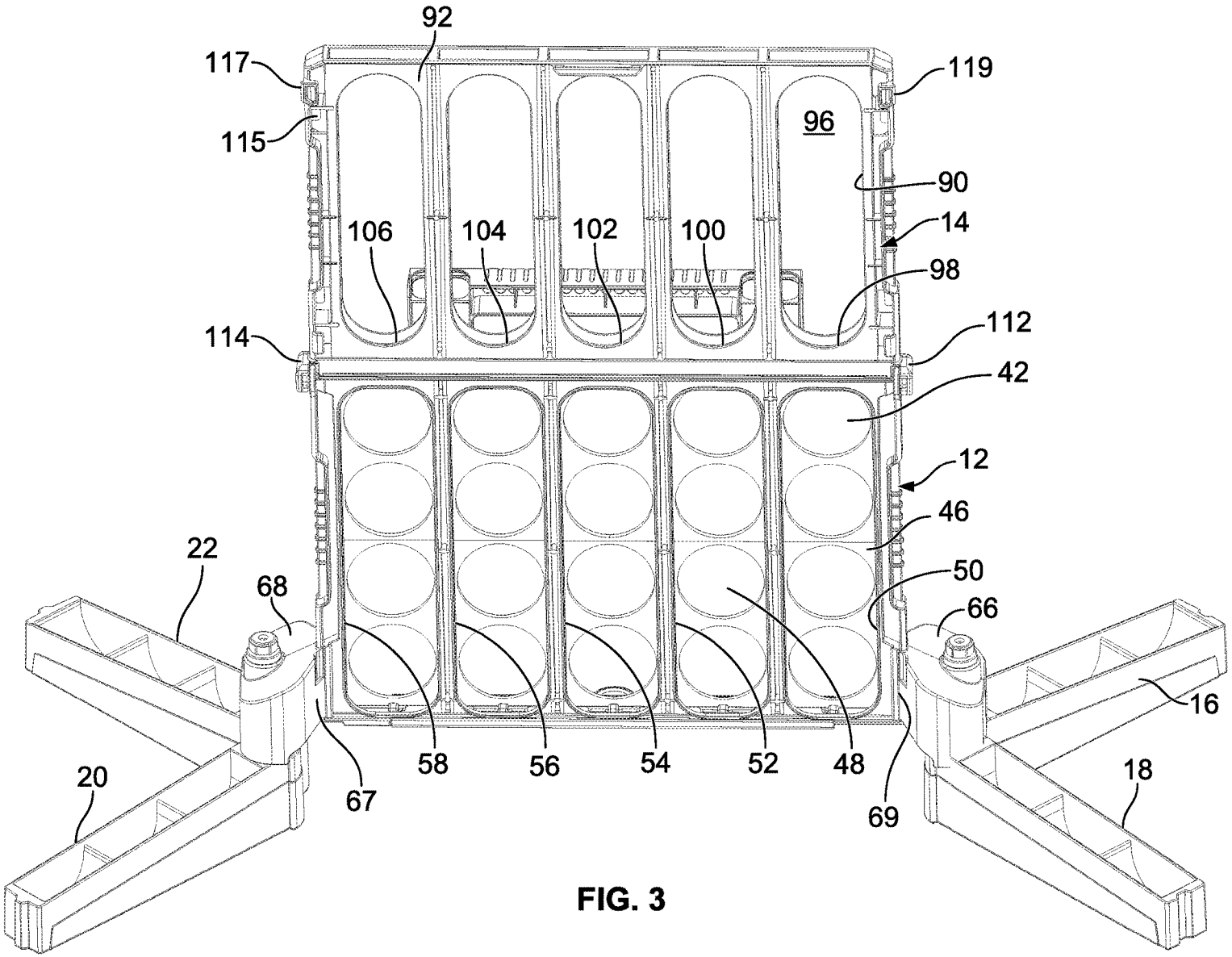
FIG. 3 is an isometric view of the opened game apparatus illustrated in FIG. 2, where front and back covers on the loading tray have been removed.

The game apparatus 10, FIGS. 1-3, includes a target grid 12, a loading tray 14 pivotally mounted to the top of the target grid 12 and rotatable around a horizontal axis, four pivotal support legs 16, 18, 20, 22 to which the target grid is mounted for supporting the target grid and the loading tray, the legs for rotating in a horizontal direction around vertical axes, and two dart 'blasters' or launchers 24, 26 mounted alongside the target grid 12. The game apparatus 10 may be easily folded for transport and/or storage and expanded for play. In FIGS. 1 and 2, the game apparatus 10 is illustrated in a fully extended, ready-for-play configuration. The loading tray 14 is positioned vertically upright or elevated above the vertically disposed target grid 12, the legs 16, 18, 20, 22 are outwardly spread-apart and the dart launchers are mounted or holstered as illustrated in FIG. 2, or as shown in FIG. 1, in the hands of players 30, 32 during play.

Figure 4:
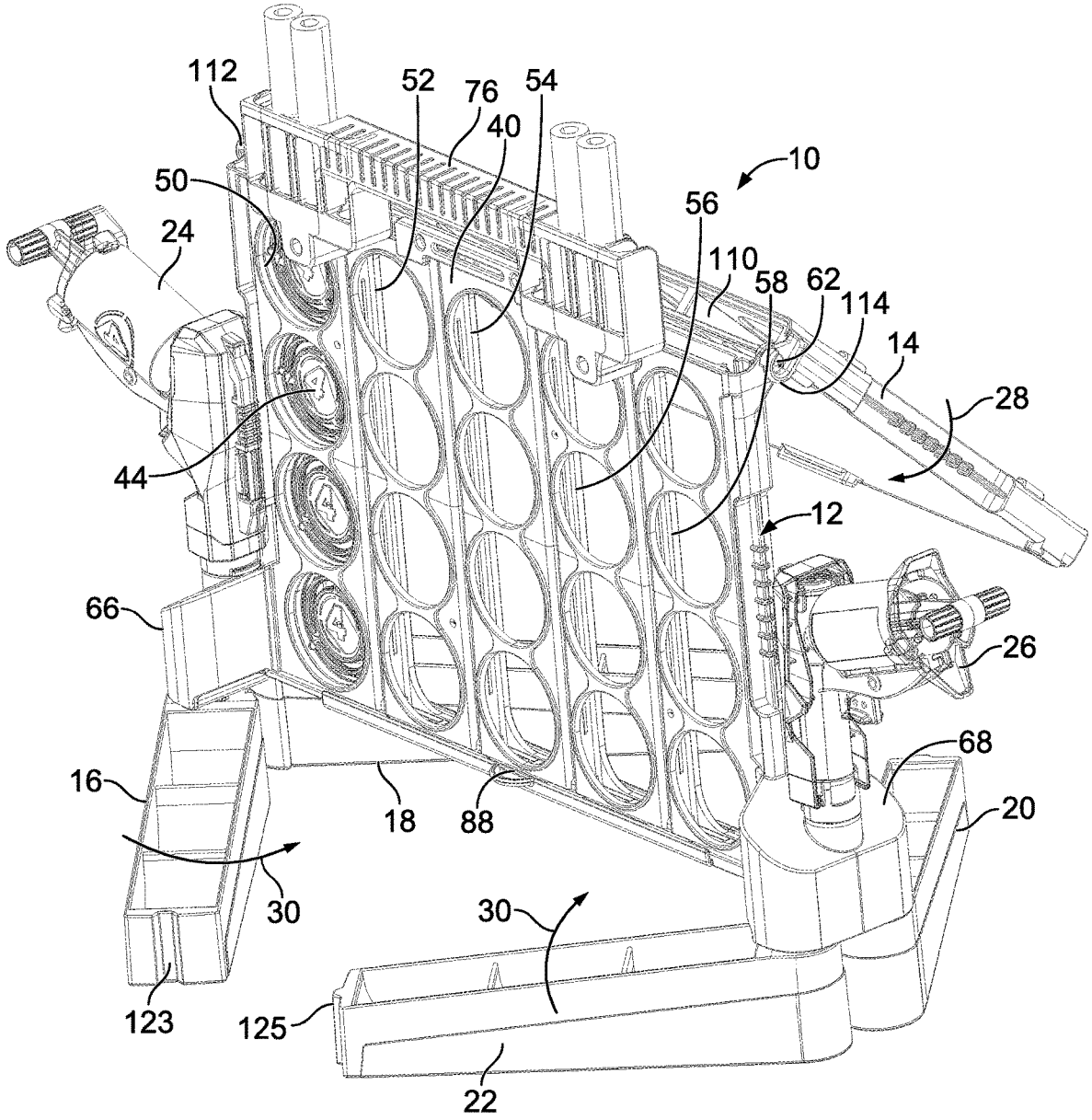
FIG. 4 is an isometric view of the game apparatus illustrated in FIG. 2, in a partially folded configuration where the loading tray is being rotated downward and the support legs are being rotated inward.
Figure 5:
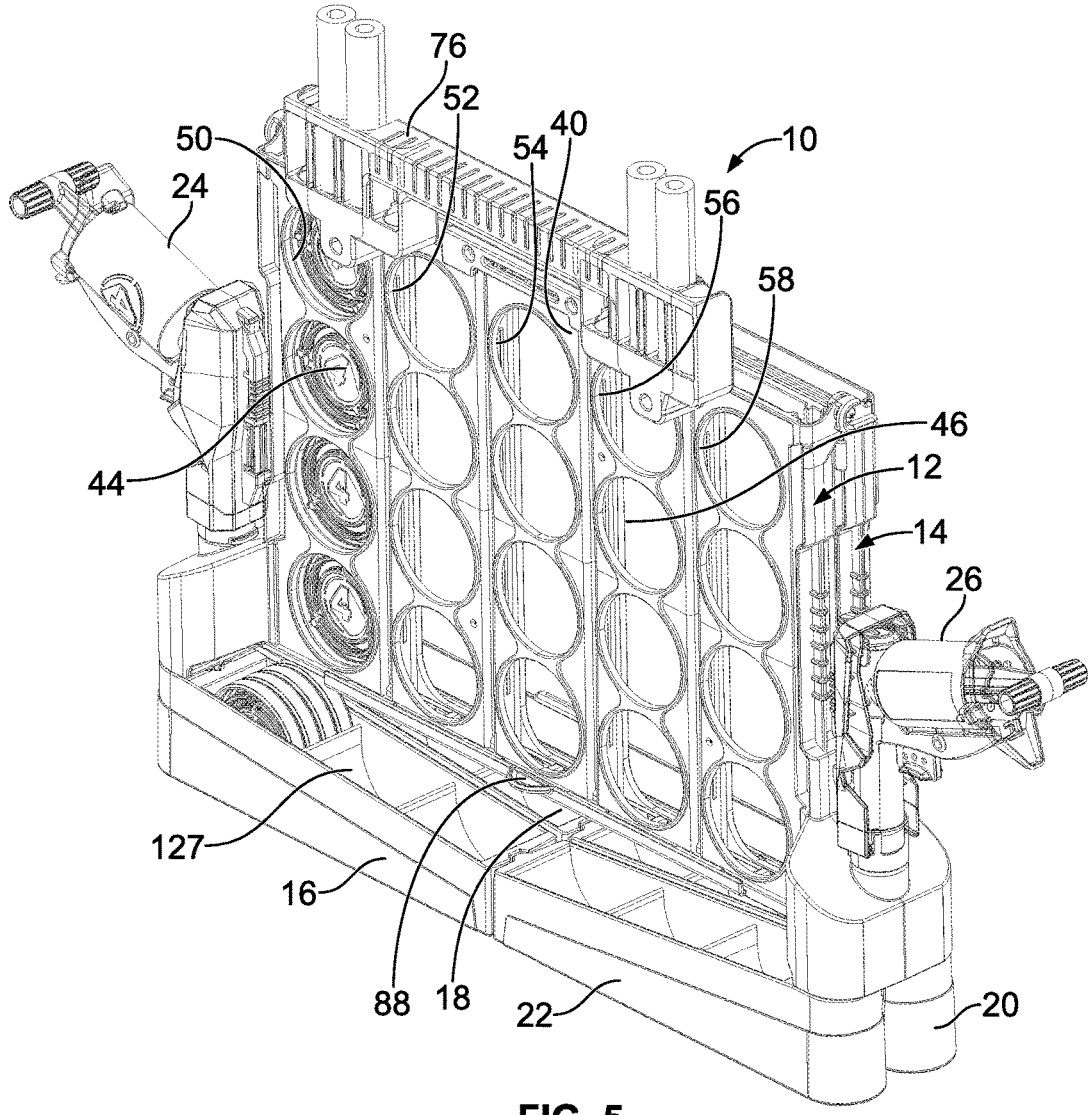
FIG. 5 is an isometric view of the game apparatus illustrated in FIGS. 2 and 4, in a fully folded configuration.

The game apparatus 10 is illustrated partially folded in FIG. 4, where the loading tray 14 is being rotated downward as symbolized by an arrow 28, and the legs 16, 18, 20, 22 are rotating inward as symbolized by arrows 30. Referring now to FIG. 5, the game apparatus 10 is illustrated in a fully folded configuration in that the loading tray 14 has been rotated downward about 180° so as to be adjoining the target grid 12, and the legs 16, 18, 20, 22 have been rotated fully inward such that the legs 16 and 18 are adjoining each other as are the legs 20 and 22. The distal ends of the legs 16 and 22 are also adjoining, as are the distal ends of the legs 18 and 20, as shown in FIG. 5. The strategic pattern building game apparatus with the target grid and rotatable loading tray movable between an elevated position above and aligned with the target grid during play and a folded position adjoining the target grid for transport and/or storage. The game apparatus includes the plurality of playing discs placed in channels in the target grid and in the loading tray, with the discs deformable as received at the target grid for being ejected during game play when impacted by the projectile.

Figure 6:
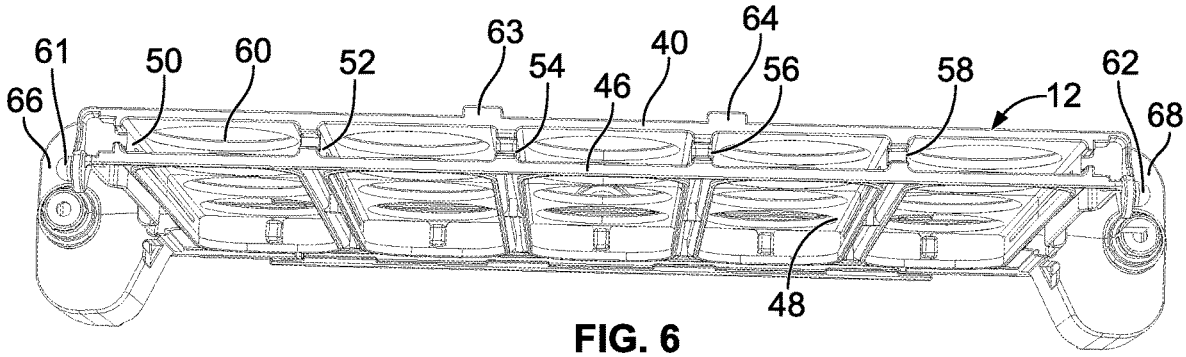
FIG. 6 is a downward looking isometric view of the target grid.

The target grid 12 may include a front wall 40, FIG. 2, with a plurality of apertures or openings, such as the opening 42, in a five by four array (that is, five columns and four rows) for viewing a plurality of playing pieces or markers, all in the form of a playing disc 44, FIGS. 1, 2, 4 and 5. The target grid 12 may also includes a back wall 46, FIGS. 3, 6 and 8, having five long vertically disposed openings, such as the opening 48, where each opening in the back wall aligns with a column of openings in the front wall. The walls 40, 46 create five enclosed channels 50, 52, 54, 56, 58, FIGS. 4-6 and 8, for receiving and holding the playing discs during play. The channels 50, 52, 54, 56, 58 enable five columns of discs to be received through five top openings, such as the top opening 60, FIG. 6, for the channel 50 of the target grid 12 such that the playing discs may slide or fall downward in each channel until all positions in the target grid array include a playing disc at the start of play. Of course, less playing discs may be use should a player desire.

Figure 7:
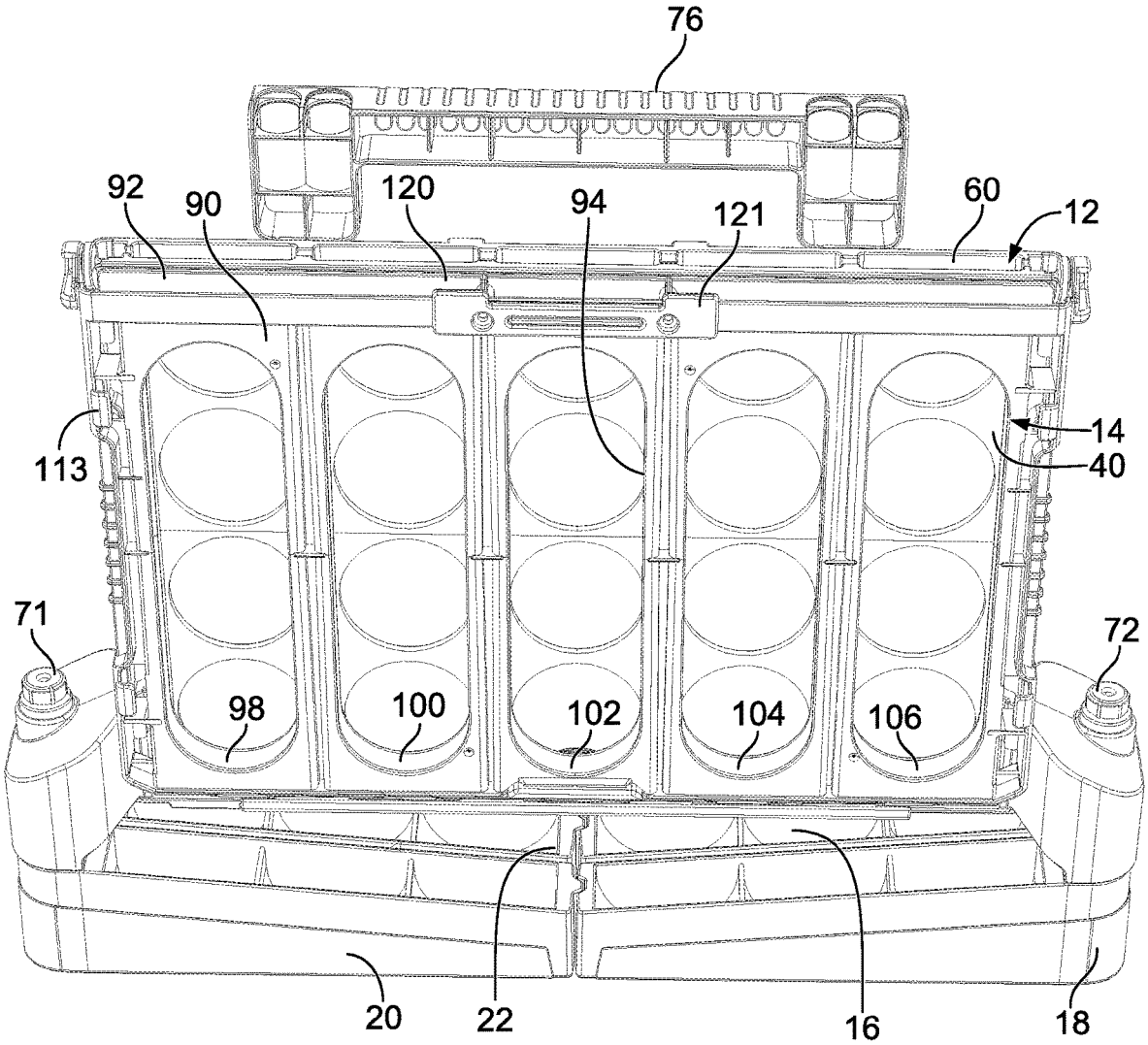
FIG. 7 is a rearward looking isometric view of the game apparatus illustrated in FIG. 3, in a fully folded configuration.

At the top of the target grid 12 are oppositely disposed shafts 61, 62, FIGS. 2, 4, 6 and 8, which form a horizontal pivot axis for the loading tray 14. Also at the top of the target grid are two snap-fit tabs 63, 64, FIG. 6, to help retain the loading tray in its elevated position. Toward the bottom of the target grid 12 are two shoulders 66, 68 for mounting the launchers 24, 26 and the legs. The launchers are mounted on posts 71, 72, FIG. 7, a post located on top of each shoulder, and the legs 16, 18, 20, 22 are mounted to the bottoms of the shoulders. The shoulders may also include snap-fit recesses 67, 69, FIG. 3 to facilitate securing the loading tray.

Figure 8:
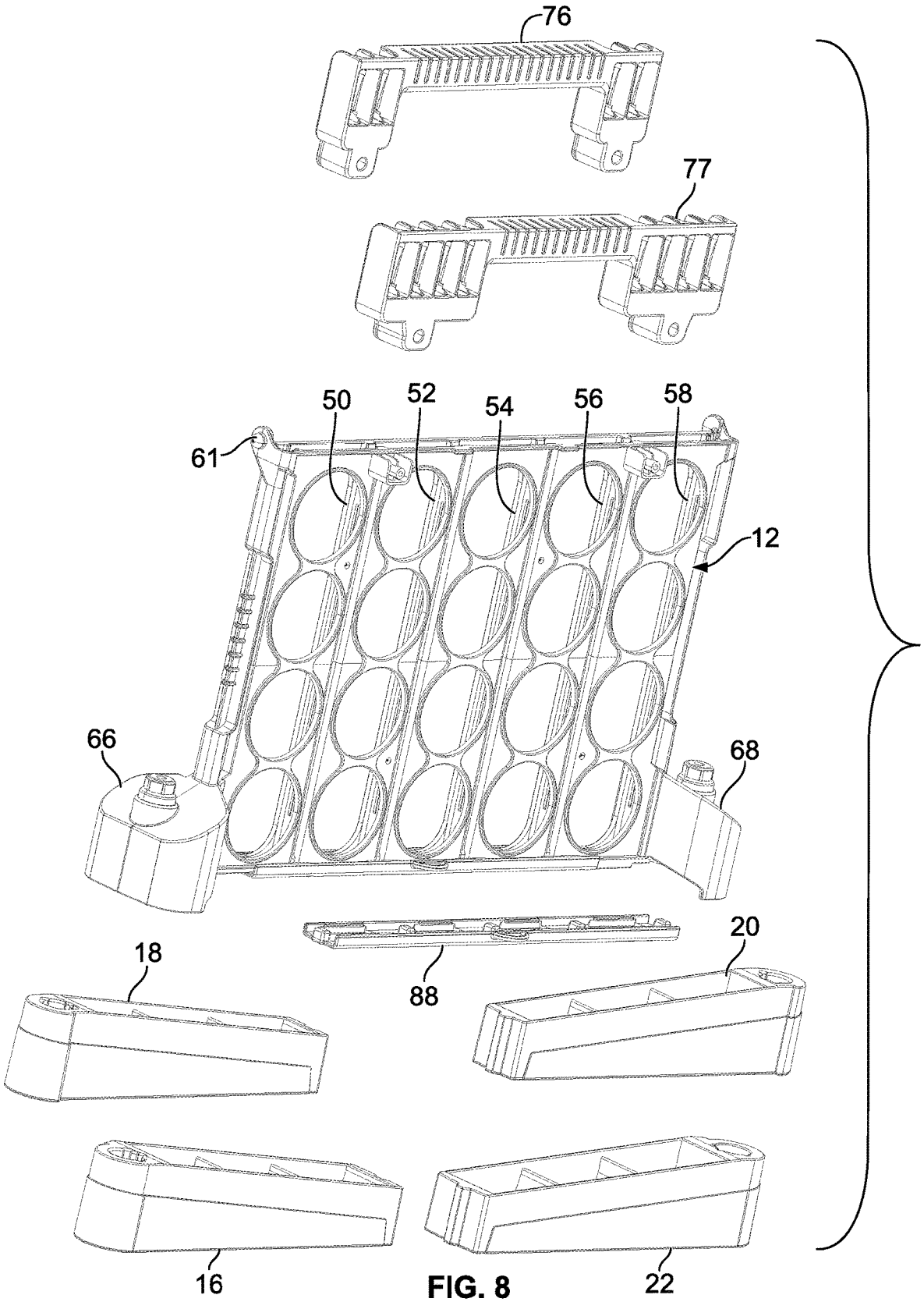
FIG. 8 is an exploded isometric view of the target grid, a handle, a retainer gate and the legs.

Mounted at the top of the target grid 12 may be a handle 76, FIGS. 4 and 5, for carrying the game apparatus 10 when the apparatus is folded. The handle 76 may also act as a dart storage device, as illustrated in FIG. 2, where the device is shown carrying four darts 80, 82, 84, 86. An alternative handle 77 is illustrated in FIG. 8, for carrying eight darts. A retainer gate 88, FIGS. 2, 4 and 5, may be slidably connected to the bottom of the target grid 12 and is movable between a first position for blocking the channels 50, 52, 54, 56, 58 so that playing discs in the target grid are prevented from dropping out, and a second non-blocking position for allowing the playing discs to fall by gravity away from the target grid when the target grid is cleared.

In the alternative, the target grid may have a different array of openings as desired, such as seven by six, six by five, eight by seven, nine by seven or eight by eight, for example. Still other arrays may be used. Also, the launchers may be mounted differently, such as on the loading tray or on the legs.

The loading tray 14 may be constructed in a manner similar to the construction of the target grid 12. The loading tray 14 may have front and back walls 90, 92, FIGS. 3, 7 and 9, where each wall may have five vertically elongated openings, such as the opening 94, FIG. 7, in the front wall 90 and the opening 96, FIG. 3, in the back wall 92. The size of the loading tray 14 enables five channels 98, 100, 102, 104, 106, FIGS. 7 and 9, to support and store the playing discs at the beginning of play.

Figure 9:
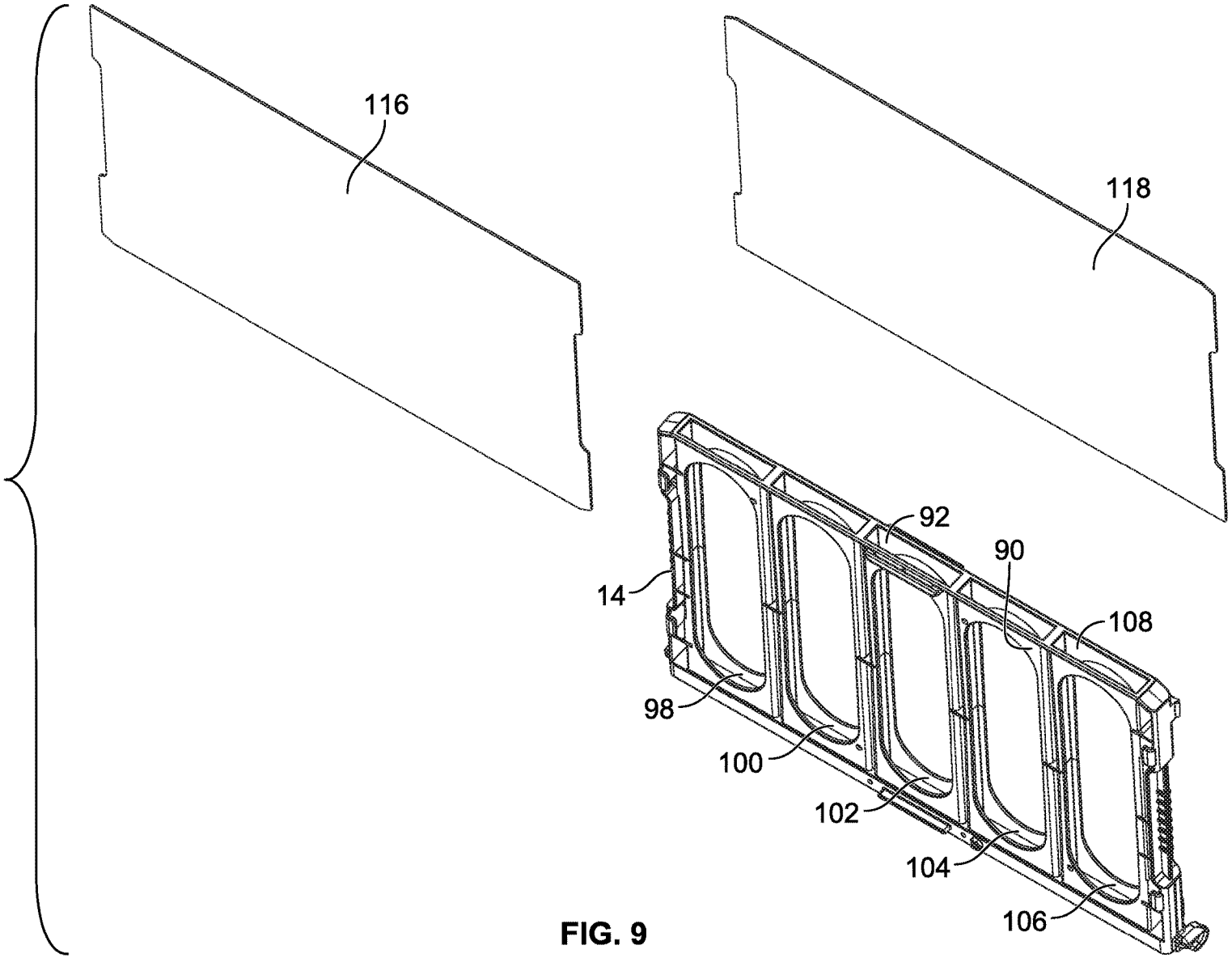
FIG. 9 is an exploded isometric view of the loading tray.

The loading tray 14 includes five top openings, one top opening for each channel, such as the top opening 108, FIGS. 2, and 9, for the channel 106, and five bottom openings for the channels, such as the bottom opening 110, FIG. 4, for the channel 106. The discs loaded in the channels 98, 100, 102, 104, 106 of the loading tray, when the game apparatus is fully opened and the loading tray is elevated and aligned with the target grid, are enabled to slide or fall from the loading tray channels 98, 100, 102, 104, 106, FIG. 3, downward, into the aligned target grid channels 50, 52, 54, 56, 58, respectively, as a space becomes available in the channels of the target grid.

At the bottom of the loading tray 14, may be two bearings 112, 114, FIGS. 3 and 4, for receipt of the shafts 61, 62 of the target grid 12 to enable the loading tray to rotate between its elevated position, vertically aligned with the target grid as shown in FIG. 2, and its folded position for transport and/or storage as shown in FIG. 5. A front cover 116, FIGS. 2 and 9, and a back cover 118, FIGS. 5 and 9, which may be made of paper, may be mounted to the loading tray 14 to hide the loading tray channels 98, 100, 102, 104, 106 from sight by the players 30, 32, FIG. 1. The loading tray may also include tabs on the front and back walls, such as the tab 113, FIG. 7, on the front wall 90, and the tab 115, FIG. 3 on the back wall 92 for mounting the covers. In addition, the loading tray may include two tabs 120, 121, FIG. 7, for engaging the grid tabs 63, 64, FIG. 6, for fastening the tray in its upright position. The loading tray may also include two snap-fit tabs 117, 119, FIG. 3, that engage the snap-fit recesses 67, 69, FIG. 6, in the target grid shoulders for fastening the tray in its folded position. The target grid 12 and the loading tray 14 may be formed of any suitable plastic.

In the alternative, each of the walls of the loading tray may include openings, like the openings in the wall 40, and the covers may be mounted differently or may be dispensed with in another variation of the game.

Referring now to FIGS. 2, 4 and 5, the legs 16, 18, 20, 22, in addition to supporting the game apparatus, may include upper recesses, such as the recess 127, FIGS. 2 and 5, to function as storage receptacles for the playing discs, as illustrated. Opposing legs may also have a groove, such as the groove 123, FIG. 4, in the distal end of the leg 16, opposite a protrusion, such as the protrusion 125 of the leg 22 for keeping the legs engaged when folded. The legs also have three detent positions that are illustrated in FIGS. 2, 4 and 5.

Figure 10:
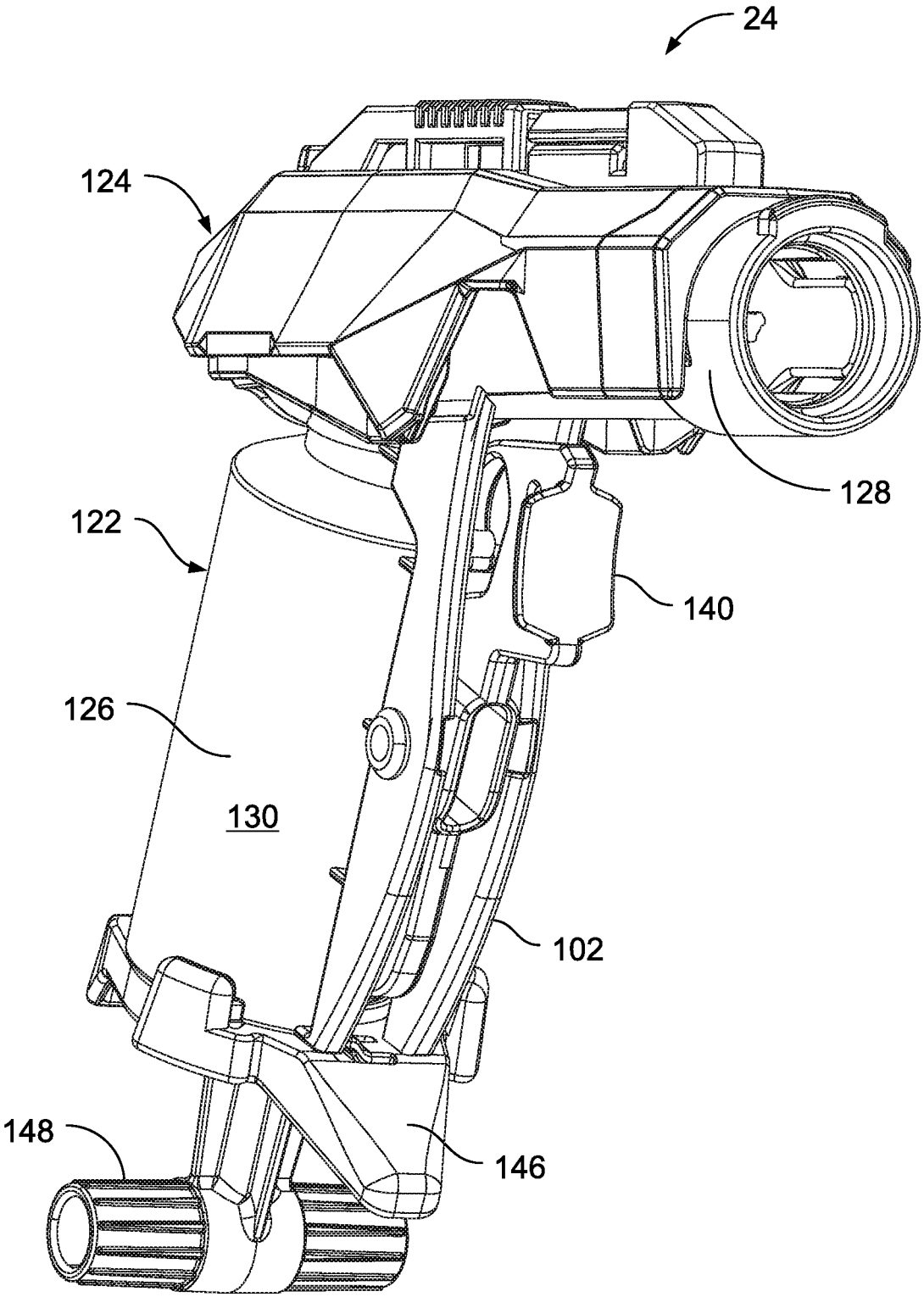
FIG. 10 is an isometric view of one of the launchers shown in FIGS. 1, 2, 4 and 5.
Figure 11:
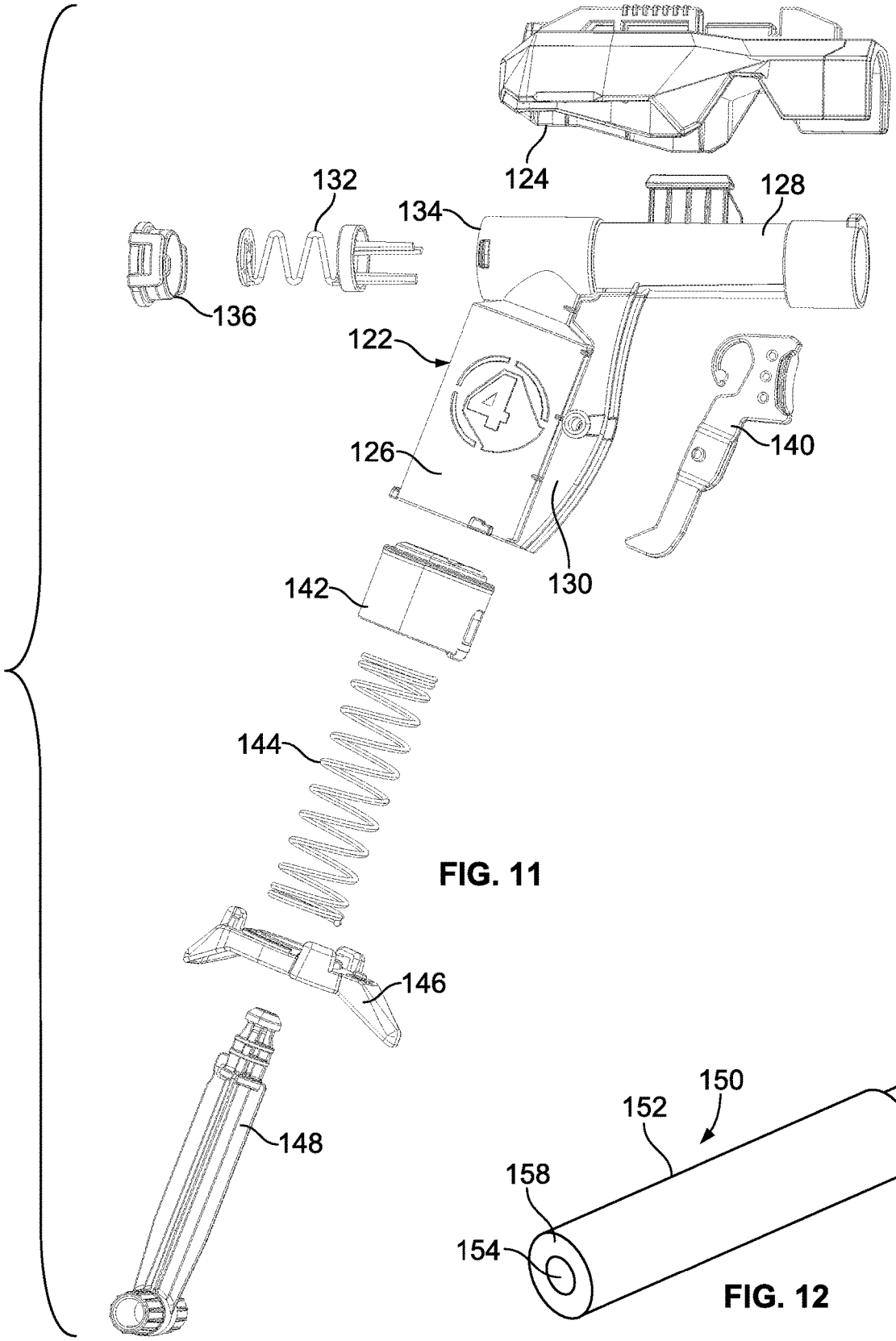
FIG. 11 is an exploded view of the launcher illustrated in FIG. 10.

Referring now to FIGS. 10 and 11, each launcher 24, 26 may take the form of a simulated pistol, that is, a small toy dart launcher or blaster, having only eight parts that are relatively inexpensive and easily assembled. The parts include a molded outer body 122 that may be covered with a top shell 124. The outer body 122 includes an integral cylinder portion 126, a barrel portion 128, and a trigger-mounting portion 130. The parts also include an integral safety valve and spring 132 mounted at the rearward end 134 of the barrel portion 128, and a valve cap 136 securing the safety valve and spring 132 in the barrel portion 128 and for preventing rotation of the integral safety valve and spring. Other parts of the launchers 24, 26 are an integral trigger 140 mounted to the body trigger-mounting portion 130, and a piston 142, a compression launch spring 144, a cylinder cap 146 and a plunger rod 148.

The plunger rod, the launch spring and the piston form a sub-assembly mounted in the cylinder portion 126 of the outer body 122 and is secured by the cylinder cap 146. The barrel portions of the launchers may be used to mount the launchers on the posts 71, 72 of the shoulders of the grid.

Figure 12:
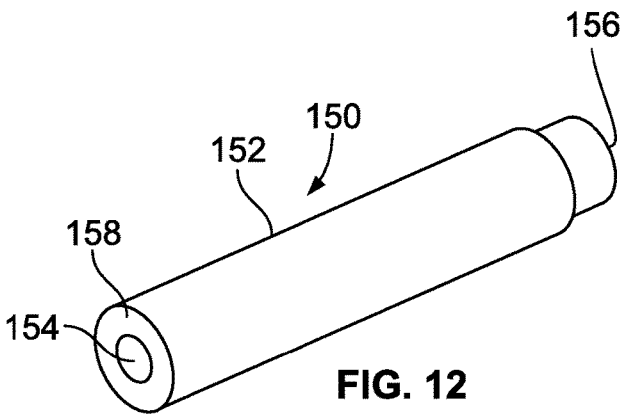
FIG. 12 is a rear isometric view of a soft foam dart capable of being shot from the launchers.
Figure 13:
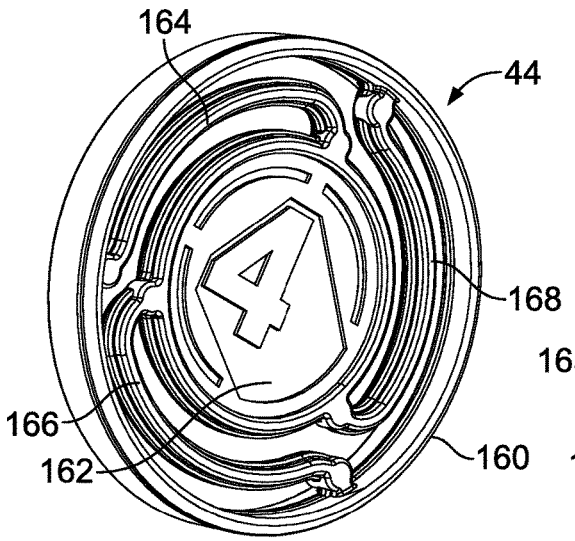
FIG. 13 is an isometric view of the playing disc embodiment illustrated in FIG. 1.

The toy launchers are designed to eject or shoot soft foam darts 150, FIG. 12, marketed under the NERF® brand. The players can shoot at any colored disc to achieve a victory or four of their own color discs in a row or on a diagonal. Moreover when a player shoots out a disc, the disc may be then re-inserted in the same column and the player can win on the opponent's turn" as described gameplay. The NERF® brand dart 150 includes a cylindrical body 152 having an open tubular center 154, a nose portion 156 and a rear ring-shaped wall 158. In the alternative, other toy launchers may be used, such as those simulating rifles, machine guns, cross-bows, bows and arrows, slingshots, lances, and the like. In addition, other soft foam projectiles may be used, such as larger or smaller darts or NERF brand RIVAL ROUNDS™ ammo.

Figure 16:
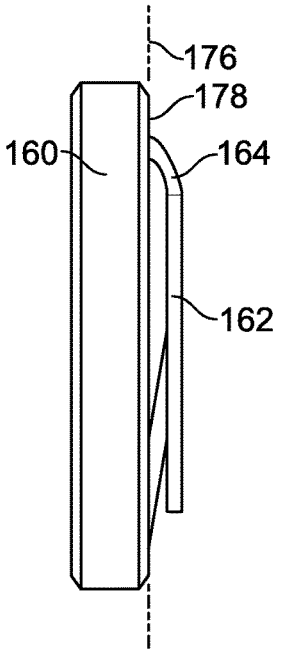
FIG. 16 is a side elevation view of the playing disc illustrated in FIGS. 13-15, deformed upon being impacted by a dart.
Figure 17:
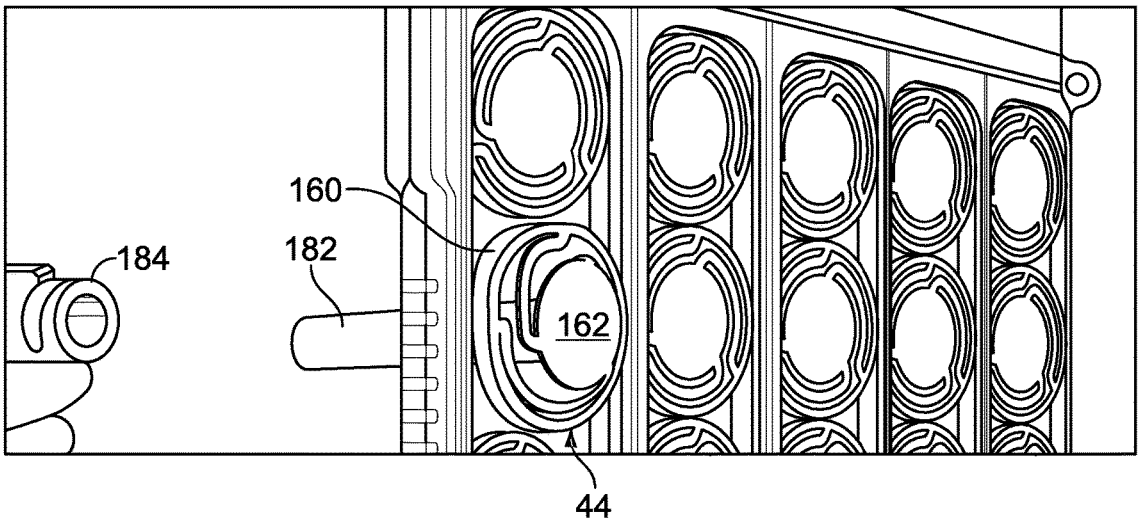
FIG. 17 is an isometric view of a portion of the target grid illustrating a playing disc impacted by a dart just prior to being popped out of the target grid.

Referring now to FIGS. 13-19, the playing disc 44 is illustrated in more detail. The disc may include a deformable outer rim 160, a centrally located impact plate 162, and three flexible and deformable arms 164, 166, 168, each arm having one end, such as the end 165 of the arm 164, connected to the rim 160 and an opposite end, such as the end 167 of the arm 164, connected to the plate 162. The arms 164, 166, 168 are somewhat analogous to spokes in that they support and locate the impact plate 162 relative to the rim 160, but here are curved in a somewhat extended and bent S-shape. The arms 164, 166, 168 are dimensioned such that when the plate 162 is impacted by a dart or other toy projectile, the plate is forced away from a plane 176, FIG. 15, defined by the rearward edge 178 of the rim 160, as shown in FIG. 16. When impacted, the playing disc is distorted or deformed sufficiently to fall or pop-out of the channels 50, 52, 54, 56, 58 of the target grid 12 as simulated in FIGS. 1 and 17, where a playing disc 44 180, in FIG. 17, is illustrated at the moment of impact by a dart 182 fired from a launcher or 'blaster' 184.

Figure 14:
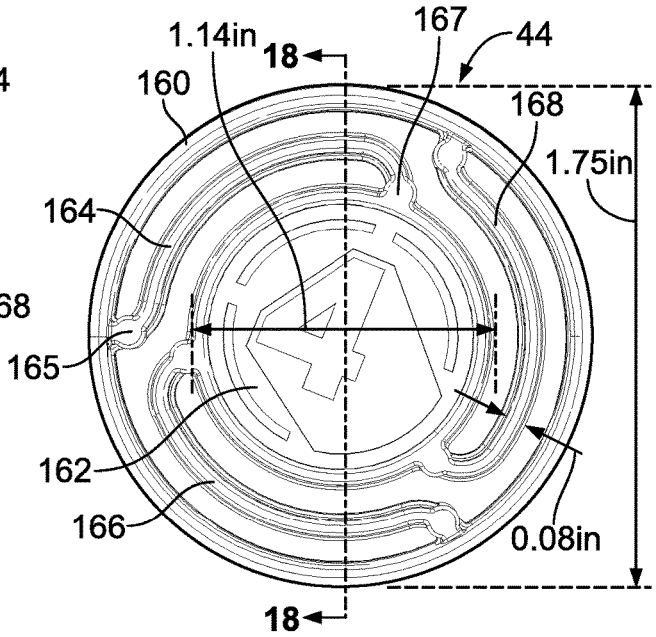
FIG. 14 is a front view of the playing disc illustrated in FIG. 13.
Figure 15:
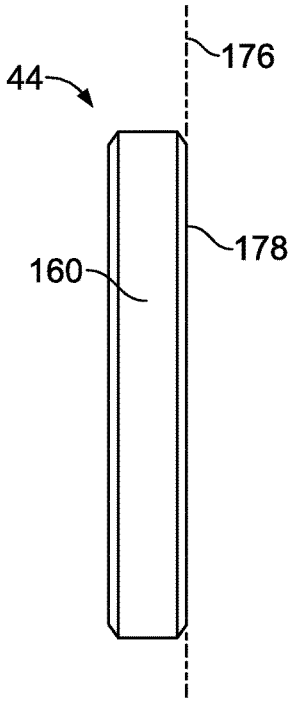
FIG. 15 is a side elevation view of the playing disc illustrated in FIGS. 13 and 14.
Figure 18:
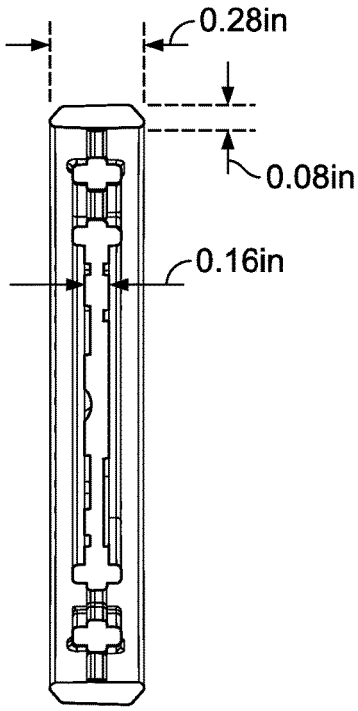
FIG. 18 is a section view taken along line 18-18 of FIG. 14.

A playing disc may have an outer diameter of about 1.75 inches, a depth of about 0.28 inch, and width of about 0.08 inch, all as shown in FIGS. 14 and 18. The plate 162 may have diameter of about 1.14 inches. Each of the arms 164, 166, 168 may have a length of roughly 1.5 inches, a depth of about 0.16 inches and a width of about 0.08 inch. The material of the playing disc may be polypropylene or any other suitable plastic. In the alternative, other designs, configurations, dimensions and/or material may be used, provided that similar deformation characteristics occur when impacted by a toy projectile. For example, the disc 44 may have about a 0.03 inch overlap with the channels of the target grid 12. Hence the rim of the disc must deform sufficiently to escape from the channel of the target grid and fall behind the game apparatus as illustrated in FIG. 1, when impacted by a projectile. A suitable playing disc must also fall relatively freely downward in the loading tray channel during loading of discs and then from the loading tray into a channel of the target grid when an existing target grid disc is expelled during play, and the suitable playing discs must also be easily and cheaply manufactured. The playing disc 44 meets all of these criterions.

Figure 19:
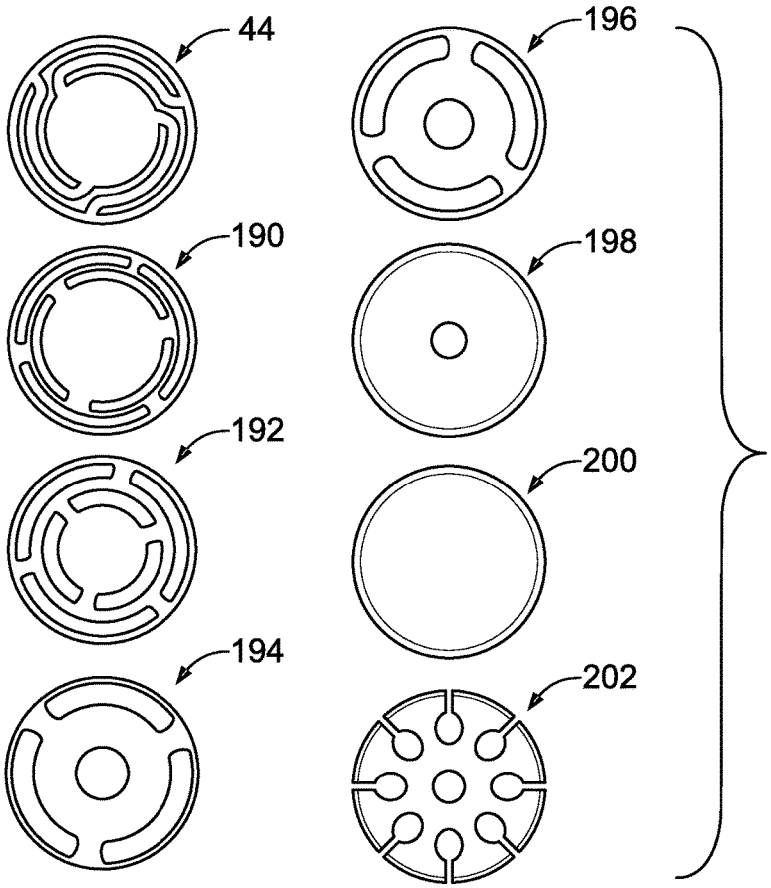
FIG. 19 is a front view of various playing discs having alternative configurations.

Referring now to FIG. 19, there are illustrated seven other disc structural configurations 190, 192, 194, 196, 198, 200, 202 in addition to the structural configuration of the disc 44. The other discs are examples of alternative configurations that may be considered although the disc 44 is considered the most preferable.

Assuming that the playing disc has a diameter of about 1.75 inches, the five by four target grid 12 may be about 8 inches high, and about 13.5 inches wide with the shoulders and about 10.7 inches without including the shoulders, and the loading tray 14 may be about 6.75 inches high and about 10.7 inches wide.

In operation, a game may begin with the game apparatus 10 in its folded or stored configuration as shown in FIG. 5. The first step then is for a player to rotate the legs 16, 18, 20, 22 outwardly to the positions shown in FIG. 2. Next, a player rotates the loading tray 14 from its folded position shown in FIG. 5, to its elevated position so that the channels 98, 100, 102, 104, 106 of the loading tray 14 are aligned with the channels 50, 52, 54, 56, 58 of the target grid 12. Then a player slides the retainer gate 88 into its blocking position to prevent playing discs from falling completely through the target grid. Next, the players load the target tray with discs having a first indicium, such as the blue discs or playing pieces. Next the players load the loading tray randomly with an equal number of discs having second and third indicia, such as red and yellow. It is noted that the players will not be able to view the random distribution of the red and yellow discs in the loading tray. Finally, each player removes a launcher from the game apparatus, loads the launcher with a dart, and primes the launcher by extending the plunger rod 148. The competition is now ready to begin.

To begin play, the players 30, 32 stand in front of the game apparatus and next to each other as shown in FIG. 1. At a start time, perhaps on the count of 'three,' the players begin shooting at the target grid to knock discs out of the grid. The first player to align four of his/her discs (red or yellow) wins the game. A player may target any disc, blue, red or yellow, in the target grid with his/her launcher. If a blue disc is popped out, it remains where it lands, on a table or floor. If a player knocks out a red or yellow disc, it is returned to the top of the loading tray. If a disc is partially knocked out, it is removed and set aside if blue, or returned to the loading tray if red or yellow.

It is noted that throughout this detailed description, words such as "upper," "lower," "front," "back," "rear," "top" and "bottom," as well as similar positional terms, refer to portions or elements of the game apparatus as they are viewed in the drawings, or in relationship to the positions of the apparatus as it will typically be deployed and moved during use, or to movements of elements based on the configurations illustrated.

Figure 20:
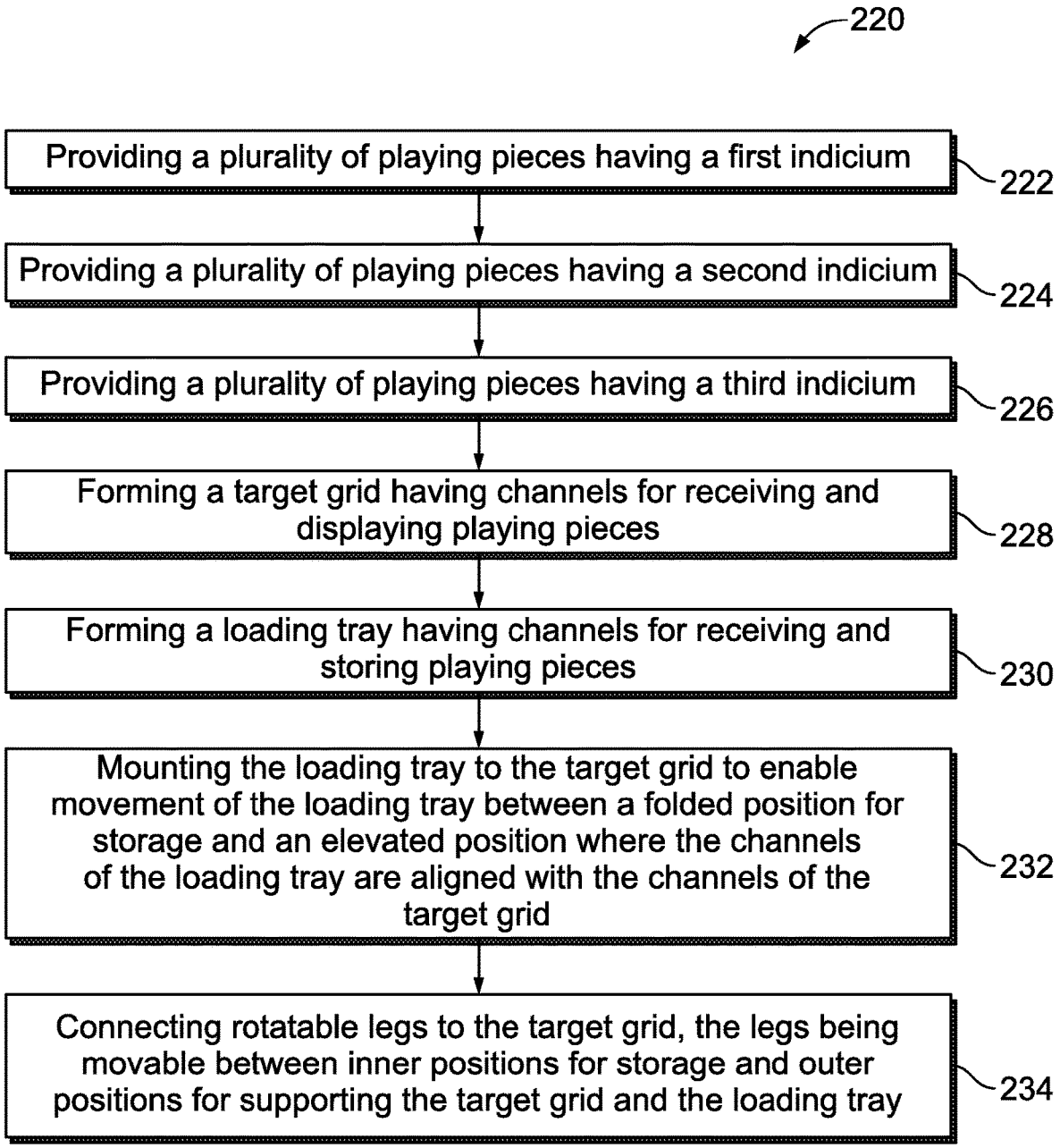
FIG. 20 is a flow diagram of a method for assembling the inventive game apparatus.

The present invention includes a method 220, FIG. 20, for assembling the inventive game apparatus 10. The method for the assembly of the game apparatus includes the steps of providing a plurality of playing discs having first a indicium 222, providing a plurality of playing discs having a second indicium 224, providing a plurality of playing discs having a third indicium 226, forming a target grid having channels 228, the target grid for receiving and displaying the playing discs having the first indicium in the channels, forming a loading tray having channels 230, the loading tray for receiving and storing the playing discs having the second and third indicia in the loading tray channels, mounting the loading tray to the target grid to enable movement between a folded position and an elevated position 232 where the channels of the loading tray are aligned with the channels of the target grid, and connecting rotatable legs to the target grid 234, the legs being movable between inner positions for storage and outer positions for supporting the target grid and the loading tray.

It may now be appreciated that the game apparatus disclosed in detail above has great entertainment value, is fun to use and easy to operate. The game apparatus is compact, lightweight and yet robust, and has a simple structure that may be produced at a reasonable cost.

From the foregoing, it can be seen that there has been provided a detailed description and features for an improved game apparatus and the playing disc as well as a disclosure of a method for assembling the game apparatus. While a particular embodiment of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only, and not as limitations. The actual scope of the invention is to be defined by the subsequent claims when viewed in their proper perspective based on the prior art.

What is claimed is:

1. A toy target game apparatus comprising: a plurality of deformable toy target apparatus; a target grid having a plurality of columns with channel shaped cross-sections, the channels having open tops and closable bottoms for receiving and storing a plurality of the deformable toy target apparatus until selected deformable target apparatus are impacted by a toy projectile launched by a player to cause the toy target apparatus to deform and fall from the target grid; and a loading tray mounted to the target grid, the loading tray having a plurality of columns with channel shaped cross-sections, the columns having open tops and bottoms for receiving a plurality of deformable toy target apparatus, wherein the loading tray is movable relative to the target grid between a folded position for storage and an elevated position for play, and when in the elevated position the columns of the loading tray and the columns of the target grid are aligned and deformable toy target apparatus are enabled to slide from the loading tray to the target grid each time a toy target apparatus has deformed and fallen from the target grid after being impacted by a projectile launched by a player.

2. The toy target game apparatus of claim 1, wherein: the loading tray is rotatably mounted to the target grid, wherein in the folded position the loading tray is disposed parallel to the target.

3. The toy target game apparatus of claim 1, including: a retainer gate connected to the bottom of the target grid for selectively blocking the bottoms of the columns of the target grid.

4. The toy target game apparatus of claim 1, including: a cover for mounting to a front wall of the loading tray to hide the loading tray columns from the players' sight.

5. The toy target game apparatus of claim 1, including: four rotatable legs mounted beneath the target grid, the legs being extended for supporting the target grid and the loading tray during play and folded inward when stored.

6. The toy target game apparatus of claim 5, wherein: the four legs include recesses for storage of a plurality of toy target apparatus.

7. The toy target game apparatus of claim 1, including: a projectile launcher mounted to each side of the target grid.

8. The toy target game apparatus of claim 1, including: a handle mounted to the top of the target grid, the handle for carrying the target grid, the loading tray, pivotal legs and two projectile launchers.

9. The toy target game apparatus of claim 8, wherein: the handle includes recesses for storing projectiles.

10. The toy target game apparatus of claim 1, including: a pair of shoulder structures connected to the target grid, each shoulder structure for supporting a projectile launcher and for connecting a pair of pivotal legs.

11. The toy target game apparatus of claim 1, wherein: the loading tray is rotatably mounted to the target grid, wherein in the folded position the loading tray is disposed parallel to the target; and including a cover for mounting to a front wall of the loading tray to hide the loading tray columns from the players' sight.

12. The toy target game apparatus of claim 11, including: four rotatable legs mounted beneath the target grid, the legs being extended for supporting the target grid and the loading tray during play and folded inward when stored.

13. The toy target game apparatus of claim 12, including: a projectile launcher mounted to each side of the target grid.

14. The toy target game apparatus of claim 13, including: a handle mounted to the top of the target grid, the handle for carrying the target grid, the loading tray, pivotal legs and two projectile launchers; and a pair of shoulder structures connected to the target grid, each shoulder structure for supporting a projectile launcher and for connecting a pair of pivotal legs.

15. A method for assembling a target game apparatus including the steps of:

providing a plurality of deformable toy target apparatus;

forming a target grid defining a plurality of columns with channels having open tops and closable bottoms therein;

receiving a plurality of the deformable toy target apparatus;

storing the plurality of the deformable toy target apparatus, such that the channels of the target grid receive and store a plurality of the deformable toy target apparatus, until selected deformable target apparatus are impacted by a toy projectile launched by a player to cause the toy target apparatus to deform and fall from the target grid;

mounting a loading tray to the target grid, the loading tray defining a plurality of columns with channels having open tops and bottoms with the loading tray movable relative to the target grid from a folded position for storage, wherein the open tops and bottoms of the columns of the loading tray receive a plurality of the deformable toy target apparatus; and moving the loading tray to an elevated position for play where the columns of the loading tray and the columns of the target grid are aligned to enable the deformable toy target apparatus to slide from the loading tray to the target grid each time a toy target apparatus has deformed and fallen from the target grid after being impacted by a projectile launched by a player.

16. The method for assembling a target game apparatus of claim 15 including the step of:

rotatably mounting the loading tray to the target grid, wherein in the folded position the loading tray is disposed parallel to the target.

17. The method for assembling a target game apparatus of claim 15 including the step of:

mounting a cover to a front wall of the loading tray to hide the loading tray columns from the players' sight.

18. The method for assembling a target game apparatus of claim 17 including the step of:

mounting a cover to a front wall of the loading tray to hide the loading tray columns from the players' sight.

19. The method for assembling a target game apparatus of claim 15 including the step of:

connecting a retainer gate to the bottom of the target grid for selectively blocking the bottoms of the columns of the target grid.

20. The method for assembling a target game apparatus of claim 15 including the step of:

a pair of shoulder structures connected to the target grid, each shoulder structure for supporting a projectile launcher and for connecting a pair of pivotal legs.

* * * * *